United States Patent [19]

Diener

[11] Patent Number: 4,937,018

[45] Date of Patent: Jun. 26, 1990

[54] ROTOR-TYPE CARBURETOR WITH IMPROVED FUEL SCAVENGING AND ATOMIZATION APPARATUS AND METHODS

[75] Inventor: Rudolf Diener, Zurich, Switzerland

[73] Assignee: Kwik Products International, Portland, Oreg.

[21] Appl. No.: 220,666

[22] Filed: Jul. 18, 1988

Related U.S. Application Data

[63] Continuation-in-part of Ser. No. 142,302, Dec. 29, 1987, which is a continuation of Ser. No. 899,667, Aug. 22, 1986, which is a continuation-in-part of Ser. No. 877,445, Jun. 30, 1986, Pat. No. 4,726,342.

[51] Int. Cl.[5] ..... F02M 29/02

[52] U.S. Cl. ..... 261/36.2; 261/88; 261/41.1; 261/DIG. 55

[58] Field of Search ..... 261/88, 36.2, 41.1, 261/DIG. 55

[56] References Cited

U.S. PATENT DOCUMENTS

| | | | |
|---|---|---|---|
| 1,120,763 | 12/1914 | Thomas | 261/62 |
| 1,371,562 | 3/1921 | Kent | 261/DIG. 55 |
| 1,618,139 | 2/1927 | Ryder | 261/DIG. 55 |
| 2,083,752 | 6/1937 | Trussell | 261/DIG. 55 |
| 2,208,317 | 7/1940 | Beck | 261/41.1 |
| 2,668,698 | 2/1954 | Rollins | 261/88 |
| 3,066,922 | 12/1962 | Wucherer | 261/41.1 |
| 3,104,272 | 9/1963 | Carlson et al. | 261/23.2 |
| 3,205,879 | 9/1965 | Von Seggern et al. | 261/23.2 |
| 3,664,648 | 5/1972 | Seeley, Jr. | 261/41.1 |
| 4,045,521 | 8/1977 | Lemonnier et al. | 261/41.1 |
| 4,162,281 | 7/1979 | Ingraham | 261/41.1 |
| 4,305,892 | 12/1981 | Hallberg | 261/41.1 |
| 4,474,712 | 10/1984 | Diener | 261/88 |

FOREIGN PATENT DOCUMENTS

| | | | |
|---|---|---|---|
| 606784 | 11/1978 | Switzerland | 261/88 |

*Primary Examiner*—Tim Miles

*Attorney, Agent, or Firm*—Hubbard, Thurman, Turner, Tucker & Harris

[57] ABSTRACT

A rotor-type carburetor is provided with a specially designed spray ring which centrifugally discharges atomized fuel droplets in two different sizes for mixture with engine-ingested air traversing the interior of the carburetor and driving its rotor section. Larger droplets are forced outwardly through an annular series of discharge openings formed in the ring, while smaller droplets are formed by the passage of fuel over an annular spray edge extending around the bottom of a radially inwardly bent lower end portion of the ring. This simultaneous formation and discharge of two series of differently sized atomized fuel droplets improves the overall performance of the engine and reduces the level of its emission pollutants. The spray ring also functions to automatically vary, in a predetermined manner, the flow rate relationship between the differently sized fuel droplets as a function of engine speed to further enhance engine performance. The carburetor is also provided with a capillary action fuel scavenging system which functions to capture fuel centrifugally discharged from the spray ring during rotor spin-down periods to prevent the undesirable delivery of fuel to the engine during such periods. Fuel captured by the scavenging system is returned to the engine fuel supply system.

35 Claims, 2 Drawing Sheets

ROTOR-TYPE CARBURETOR WITH IMPROVED FUEL SCAVENGING AND ATOMIZATION APPARATUS AND METHODS

CROSS-REFERENCE TO RELATED APPLICATIONS

This application is a continuation-in-part of my copending U.S. application Ser. No. 142,302, filed on Dec. 29, 1987 and entitled "Improved Rotor-Type Carburetor Apparatus and Associated Methods", which is hereby incorporated herein by reference. U.S. application Ser. No. 142,302 was a continuation of U.S. application Ser. No. 899,667 filed on Aug. 22, 1986 which was a continuation-in-part of U.S. application Ser. No. 877,445 filed on June 30, 1986 now U.S. Pat. No. 4,726,342 issued Feb. 23, 1988.

BACKGROUND OF THE INVENTION

The present invention relates generally to constant fuel-air ratio, rotor-type carburetors utilized in internal combustion engines, and more particularly provides a rotor-type carburetor which uniquely reduces the emission pollutant levels of its associated engine, while at the same time increasing the engine's power output and fuel efficiency.

The rotor-type carburetor, also referred to as a "central injection device", has been proposed, in various versions thereof, as a replacement for the conventional carburetor in a variety of internal combustion spark ignition engines because of its very advantageous provision of an essentially constant fuel-air ratio at all operating speeds of the engine. In its basic operating format, the rotor-type carburetor is provided with a bladed turbine rotor section which is coaxially and rotationally disposed in the air intake passage of the engine upstream of the butterfly damper therein. During operation of the engine, ambient air drawn inwardly through the engine's air intake passage causes rapid rotation of the bladed rotor section. A centrifugal pumping mechanism formed within the rotor draws fuel from a source thereof into the rotor and forces the received fuel outwardly therethrough, via at least one lateral fuel discharge bore, onto and across a coaxial atomization or spray ring into the ingested air stream. Importantly, the quantity of atomized fuel entering the air stream is in an essentially constant ratio to the ingested quantity of air, thereby essentially eliminating the fuel-air ratio variation problems commonly encountered in conventional carburetors.

An added benefit of many previously proposed rotor-type carburetors is their beneficial reduction in emission pollutant levels in their associated engines, and concomitant increase in the power outputs and fuel efficiency of such engines. In certain instances, however, it is necessary or desirable to further improve the operation of the carburetor to even further reduce the emission pollutant levels of its associated engine, and increase the output power and fuel efficiency of such engine. It is accordingly a primary object of the present invention to provide further improvements of these types in a rotor-type carburetor.

SUMMARY OF THE INVENTION

In carrying out principles of the present invention, in accordance with a preferred embodiment thereof, an improved rotor-type carburetor is provided which has a hollow cylindrical body that is axially insertable into the air induction pipe of an internal combustion engine. Coaxially and rotatably supported within the body is a bladed turbine rotor which is rotationally driven by engine-ingested combustion air drawn through the air flow passage defined by the interior surface of the body. An internal passageway system formed within the rotor functions as a centrifugal pump which draws fuel from the engine's fuel supply system and discharges the fuel through a laterally facing metering orifice interposed in the passageway system.

Fuel discharged from the metering orifice is flowed through the balance of the passageway system onto the radially inner surface of a specially designed spray ring which is coaxially press-fitted onto a lower end of the turbine rotor body and extends downwardly therefrom. A lower end portion of the spray ring is bent radially inwardly at an angle within the approximate range of 10°–20° (preferably about 14°) and terminates at its lower end in a relatively sharp annular spray edge that defines the lower boundary of its radially inner surface. An annular, mutually spaced series of small fuel discharge openings are formed laterally through the ring at the juncture between its straight and radially bent axial portions.

During operation of the carburetor, a first portion of the fuel flowed onto the inner surface of the spray ring from the metering orifice is centrifugally discharged through the spray ring discharge openings in the form of a first series of relatively large atomized fuel droplets. The balance of the metered fuel flowed onto the inner surface of the spray ring is radially discharged therefrom across its annular spray edge in the form of a series of relatively small atomized fuel droplets which are of a predetermined, smaller size relative to the first series of droplets being simultaneously discharged radially outwardly through the spray ring fuel discharge openings. The simultaneously discharged series of relatively large and relatively small atomized fuel droplets are entrained and swept away by the ingested air flow through the carburetor body and are drawn into the engine in the form of the aforementioned, essentially constant ratio fuel-air mixture.

This unique simultaneous formation and discharge into the ingested air flow of atomized fuel droplets of two different, predetermined sizes has been found to advantageously increase the power output and fuel efficiency of the engine, while at the same time reducing the emission pollutant levels thereof.

In addition to producing this dual discharge flow of differently sized fuel droplets, the spray ring also uniquely functions to automatically vary, in a predetermined manner, the flow rate ratio between the relatively large fuel droplets and the relatively small fuel droplets as a function of engine speed. Specifically, in a preferred embodiment thereof, the spray ring functions to maintain the flow rate of the larger fuel droplets at a higher level than the flow rate of the smaller fuel droplets at a low end portion of the overall speed range of the engine—a condition which has been found to provide increased start-up efficiency of the engine. However, during the balance of the speed range of the engine, the spray ring automatically functions to more closely equalize the flow rates of the larger and smaller fuel droplets—a condition which has been found to increase the power output and fuel efficiency of the engine, and reduce its emission pollutant levels, in the post-start portion of its overall speed range.

The relative size relationship between the two series of atomized fuel droplets being continuously formed and discharged into the ingested air stream by the spray ring, as well as the droplet flow rate ratio variation, may be conveniently altered to suit the operating characteristics of a particular engine simply by altering various aspects of the spray ring geometry. For example, the size of the larger droplets relative to the smaller droplets may be selectively varied by appropriately changing the size of the spray ring discharge openings—larger openings producing smaller droplets and vice versa. Similarly, the large-small droplet flow rate ratio, and its variation characteristics, may be selectively altered by changing the size of the discharge openings, their relative spacing, the axial length of the radially bent end portion of the spray ring and/or the angle at which such end portion is inwardly bent.

The means for forming and discharging the larger fuel droplets may take a variety of forms other than the annular series of discharge openings extending radially through the spray ring above the annular spray edge at its lower end. For example, an annular series of axially extending slots could be formed in the radially inner surface of the spray ring, such slots extending downwardly through the annular spray edge.

To further reduce the emission pollutant level of its associated engine, the improved rotor-type carburetor of the present invention is provided with a fuel scavenging system which functions to capture fuel discharged from the turbine rotor, during spin-down periods thereof in the absence of air flow through the carburetor, which would otherwise be unnecessarily and undesirably delivered to the engine and at least temporarily increase its emission pollutant levels and decrease its fuel efficiency.

In a preferred embodiment thereof, the fuel scavenging system comprises an annular groove formed in the interior surface of the carburetor body which coaxially and outwardly circumscribes the spray ring adjacent its lower end. An axially stacked series of relatively thin washer elements are captively retained within the groove and define therebetween annular capillary passages. A small fuel return conduit communicates at one end thereof with the interior of the groove, and is operatively connected at its other end to a venturi fitting interposed in the fuel recirculating line interconnected between the engine's fuel pump and its fuel tank.

When air flow through the carburetor is terminated, the larger and smaller atomized fuel droplets radially discharged from the still-spinning spray ring strike the radially inner surfaces of the stacked washers and/or the interior carburetor body surface above them. Fuel striking these surfaces is drawn by capillary action through the annular spaces between the stacked washers and into the annular carburetor body groove. Fuel captured in this manner in the groove is drawn outwardly therefrom, via the fuel return conduit, by the venturi fitting and flowed into the fuel recirculating line for return to the engine's fuel tank.

When air flow through the carburetor body is reestablished, the engine-ingested air axially sweeps away the fuel droplets being radially discharged from the spinning spray ring to prevent the droplets from being captured by the capillary washer structure and returned to the engine's fuel supply system as previously described.

DETAILED DESCRIPTION

Figure 1:
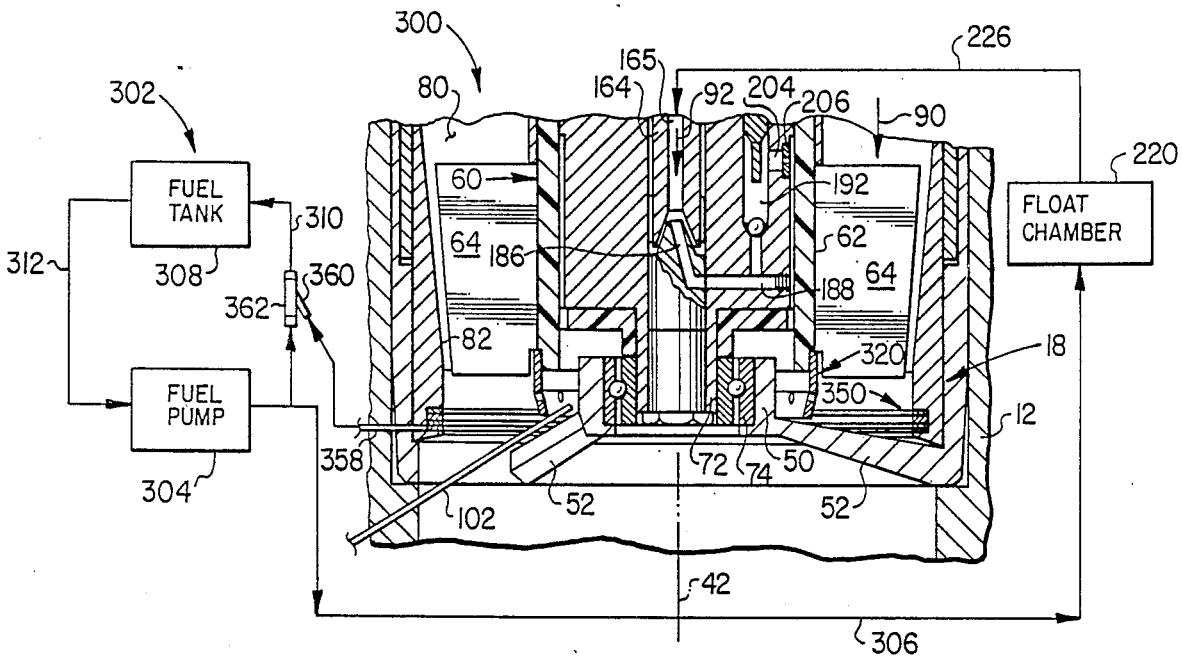
FIG. 1 is a fragmentary cross-sectional view through a lower end portion of a rotor-type carburetor which embodies fuel scavenging and atomization principles of the present invention and is installed in the air induction pipe of an internal combustion engine, and further illustrates, in schematic form, the engine's fuel supply system.

Cross-sectionally illustrated in FIG. 1 is a lower end portion of a rotor-type carburetor 300 which embodies principles of the present invention. With the exception of the construction and operation of its atomizing spray ring and fuel scavenging system portions, the carburetor 300 is identical to the rotor-type carburetor depicted in FIG. 1 of my copending U.S. application Ser. No. 142,302 which has been incorporated by reference herein. Carburetor 300 has a hollow cylindrical body 18 which is coaxially carried within an upper end portion of the air induction pipe 12 of an internal combustion engine (not shown). The body 18, as described in my referenced copending application, is of a three piece, telescoped construction. However, it will be readily appreciated that the principles of the present invention may be readily incorporated into rotor-type carburetors having a variety of alternate body constructions.

Coaxially positioned inwardly of the lower end of the carburetor body 18 is a generally annular lower support member 50 which is carried by three generally radially extending support arms 52 (only two of which are illustrated) that extend inwardly from the lower end of the body 18. A turbine rotor assembly 60 is coaxially disposed within the carburetor body 18 for rotation about its axis 42, the assembly 60 having a cylindrical rotor body 62 from which a circumferentially spaced series of turbine blades 64 radially outwardly project. The rotor body 62 has a lower end central support boss 72 which is received within the inner race portion of a ball bearing 74 that is press-fitted into the annular lower support member 50.

The rotor body 62 defines with the interior surface 82 of the body 18 an annular air flow passage 80 which extends axially through the carburetor body 18 and downwardly across the turbine blade 64. During operation of the engine, ambient air 90 is ingested downwardly through the air flow passage 80 and flowed across the turbine blades 64, thereby causing rapid rotation of the turbine rotor assembly 60. In a manner more fully described in my copending application Ser. No. 142,302, there is formed within the rotor body 62 an internal passageway system which defines centrifugal pump means that function in response to rotation of the turbine rotor 60 to draw fuel 92 into the rotor body 62. Such fuel is delivered to the carburetor 300 by a generally conventional fuel supply system 302 operatively associated with the engine and schematically depicted in FIG. 1.

System 302 includes a fuel pump 304 which supplies fuel to a float chamber 220 via a supply conduit 306. The float chamber 220 is operatively communicated with the fuel inlet of the carburetor by a fuel flow passage 226. The fuel supply system 302 also includes a fuel tank 308 which is connected to the fuel pump 304 by a fuel recirculation line 310 interconnected between the supply conduit 306 and the inlet of the fuel tank, and a fuel recirculation line 312 which is interconnected between the outlet of the fuel tank and the inlet of the fuel pump.

During operation of the carburetor 300, fuel 92 from the float chamber 220 is drawn, via the fuel passage 226, into a central passage 165 extending axially through a fuel supply tube 164 about which the rotor body 62 rotates, the passage 165 defining an inlet portion of the passageway system within the rotor body. The fuel 92 exiting the passage 165 is centrifugally forced through the internal passageway portions 186, 188, 192 and 204, and is then laterally discharged through a metering orifice 206.

Figure 2:
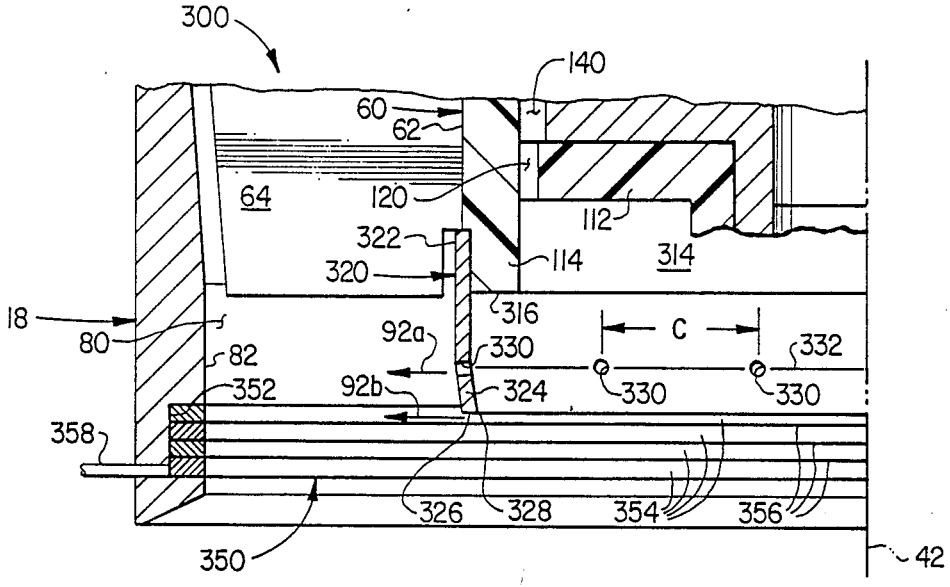
FIG. 2 is an enlarged cross-sectional view through a lower left interior section of the carburetor of FIG. 1 illustrating portions of its capillary fuel scavenging scavenging system and its specially designed fuel atomizing spray ring.
Figure 3:
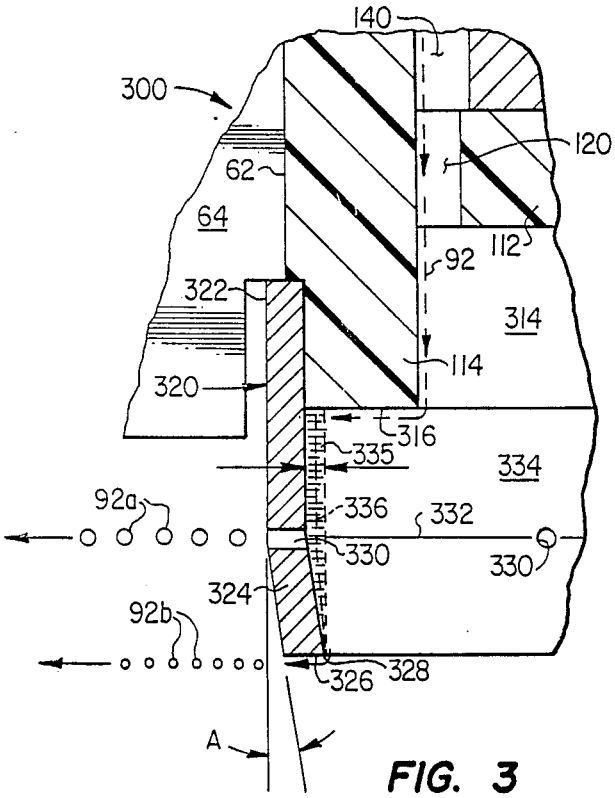
FIG. 3 is an enlarged scale cross-sectional view through a left portion of the spray ring in FIG. 2, and its upwardly adjacent supporting structure, and schematically depicts the unique manner in which the spray ring functions to centrifugally form and discharge atomized fuel droplets of two different sizes to significantly improve the overall performance of the engine.

Referring now to FIGS. 1-3, the metered fuel 92 laterally discharged through the orifice member 206 flows downwardly through a series of small axial passages 140 formed in the carburetor body and is downwardly discharged through a circular body closure portion 112 via a series of small fuel discharge openings 120 formed axially through the closure portion 112 adjacent its periphery. Fuel 92 downwardly exiting these openings 120 flows downwardly in a thin layer along the interior surface 314 of a downwardly extending annular skirt portion 114 that defines the lower end of the rotor body 62. This thin layer of metered fuel 92 is then centrifugally forced radially outwardly along the annular lower end surface 316 of the skirt portion 114.

According to an important feature of the present invention, the metered fuel 92 exiting the turbine rotor body 62 in this manner is discharged into the air flow passage 80, for mixture with the ingested flow of combustion air 90, in the form of a first series of relatively large atomized fuel droplets $92_a$ and a second series of relatively small atomized fuel droplets $92_b$ by means of a specially designed metal spray ring 320. This unique simultaneous discharge of the differently sized atomized fuel droplets $92_a$ and $92_b$ has been found to advantageously improve the combustion characteristics of the fuel-air mixture created by the carburetor 300. Specifically, such production of the differently sized atomized fuel droplets, which have a predetermined size ratio, has been found to increase the power output and fuel efficiency of the engine while at the same time reducing its emission pollutant levels.

In a manner similar to that described in my copending U.S. application Ser. No. 142,302 (and U.S. application Ser. No. 877,445 incorporated by reference therein), fuel flow to the interior side surface of spray ring 320 from the orifice member 206 may be intermittently augmented by an external fuel injection system (not illustrated herein) which discharges fuel through a fuel discharge tube 102 (FIG. 1), an outer, open end portion of which projects into the interior of the spray ring and is operative to spray fuel onto its internal side surface.

Spray ring 320 has an axial upper end portion 322 which is coaxially and externally press-fitted onto the skirt portion 114 of the rotor body 62. A lower axial end portion 324 of the spray ring 320 is radially inwardly bent at an angle "A" which is in the range from about 10° to about 20°, and is preferably approximately 14°. The annular lower end surface 326 of the radially inwardly bent spray ring portion 324 is provided at its radially inner periphery with a relatively sharp corner which defines an annular spray edge portion 328 of the spray ring. A circumferentially spaced, annular series of relatively small diameter circular fuel discharge openings 330 extend laterally outwardly through the spray ring 320 generally through the juncture 332 between its axial portions 322 and 324.

Figure 4:
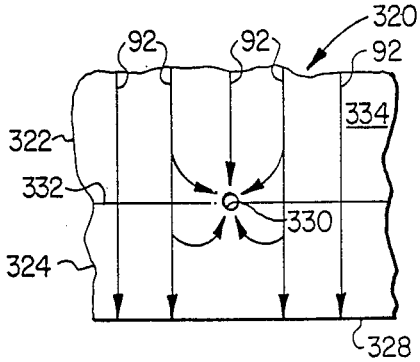
FIG. 4 is a fragmentary interior side elevational view of the spray ring and schematically depicts the flow of fuel around and outwardly through one of a series of small fuel discharge openings formed therethrough.

Referring now to FIGS. 3 and 4, during operation of the carburetor 300, the thin layer of metered fuel 92 which is centrifugally forced radially outwardly along the lower end surface 316 of the skirted body portion 114 comes into contact with and flows downwardly along the radially inner side surface 334 of the spray ring 320. A first portion of this metered fuel is centrifugally forced outwardly through the fuel discharge openings 330 to thereby form the generally radially outwardly directed series of relatively large atomized fuel droplets $92_a$ at each of the discharge openings 330. The balance of the metered fuel 92 flowing downwardly along the spray ring interior surface 334 (by gravity) is centrifugally forced outwardly across the spray edge 328 to form the series of relatively small atomized fuel droplets $92_b$ which are radially outwardly directed around the annular lower end periphery of the spray ring 320.

Figure 5:
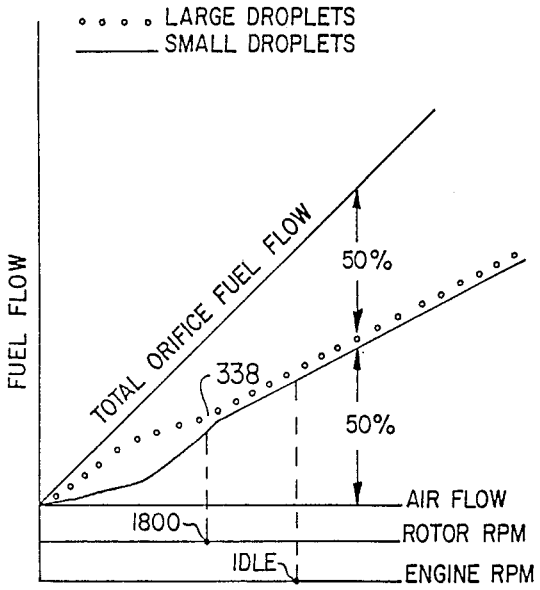
FIG. 5 is a graph illustrating a representative flow rate relationship between the differently sized droplets as a function of total fuel flow through the carburetor versus the air flow rate, rotor speed and engine speed.

The uniquely constructed spray ring 320, in addition to simultaneously forming and radially discharging the series of differently sized atomized fuel droplets $92_a$ and $92_b$, also uniquely functions to automatically vary, in a predetermined manner, the ratio of the flow rate of the larger droplets $92_a$ to the flow rate of the smaller fuel droplets $92_b$ as a function of engine speed. The graph of FIG. 5 illustrates the general nature of this flow rate ratio variation achieved by the depicted preferred embodiment of the spray ring of the present invention. It can be seen in the graph that at a low, "startup" end of the engine's overall speed range (which generally terminates at a rotor speed of approximately 1800 rpm), the flow rate of the larger atomized fuel droplets $92_a$ is appreciably larger than the flow rate of the smaller fuel droplets $92_b$. In developing the present invention, it has been found that this flow rate predominance of the larger fuel droplets over the flow rate of the smaller fuel droplets provides significantly enhanced engine startup efficiency.

However, during the balance of the engine's overall speed range (i.e., beyond its lower end or "startup" range) the spray ring 320 automatically functions to at least generally equalize the flow rates of the large and small atomized fuel droplets. It has further been found in developing the present invention that this at least approximate equalization in the large droplet-small droplet flow rates provides a droplet blend which is believed to optimize the combustion characteristics of the fuel-air mixture over a normal operating speed range of the engine which encompasses its idle speed.

The exact mechanism by which the uniquely configured spray ring 320 creates this advantageous variation of the larger droplet-small droplet flow rate ratio as a function of engine speed is not fully understood at this time. However it is believed that the spray ring generally functions in the following manner to control the flow rates of the large and small fuel droplets in the manner depicted in greatly simplified form in the graph of FIG. 5.

Referring again to FIG. 3, it can be seen that the radially bent portion 324 of the spray ring defines with the balance thereof an annular dam or weir area 335 positioned below the skirted body portion 114 and having a radial depth "B" equal to the distance which the spray edge 28 is inwardly offset from the interior side surface of the spray ring portion 322. During an initial spin-up period of the turbine rotor, the metered fuel 92 flowing downwardly along the interior surface 334 of the spray ring forms a fuel layer 336 around its periphery, the thickness of such fuel layer increasing until it fills the weir area 334.

As the radial depth of the fuel layer 334 is increasing to the weir depth "B", the fuel traveling along the inwardly sloped inner side surface of the spray ring portion 324 must overcome the centrifugal force thereon to reach and radially traverse the annular spray edge 328. As the fuel layer 334 is thickening, the fuel discharge openings 330 define, in effect, an outlet path of lesser resistance compared to the alternate fuel outlet path traversing the spray edge. Accordingly, during this initial period of rotor spin-up, the flow rate of the larger droplets $92_a$ is maintained at a higher level than the flow rate of the smaller droplets $92_b$.

However, when the radial depth of the annular fuel layer 336 increases to depth "B", the fuel 92 may more easily downwardly overflow the annular weir area 334, and flow radially outwardly across the annular spray edge 328. At the point in time in which the fuel layer 336 attains a radial depth "B", the larger droplet and small droplet curves on the graph in FIG. 5 generally merge (at a point 338) and thereafter continue in a generally coincident manner representing the at least general equalization of the flow rates of the droplets $92_a$ and $92_b$. As the flow rate of the metered fuel 92 is further increased, the general equality between the flow rates of the droplets $92_a$, $92_b$ continues as depicted in the FIG. 5 graph.

It is theorized that this continuing equality between the flow rates of the droplets $92_a$, $92_b$ is maintained by the operation of the discharge openings 330 which, in some manner, function as "regulators" to generally balance the larger and small droplet flow rates along the engine speed range portion to the right of the merger point 338.

Figure 6:
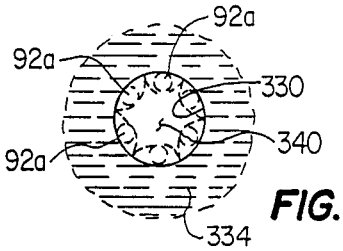
FIGS. 6, 7 and 8 are greatly simplified schematic illustrations depicting the effect on the size of fuel droplets centrifugally discharged outwardly through one of the spray ring openings caused by varying the size of such opening.

As previously described, the droplets $92_a$, $92_b$ are respectively formed by the discharge openings 330 and the annular spray edge 328 and are maintained in a predetermined size relationship. The size of the larger droplets $92_a$, and thus the larger-to-small droplet size ratio, may be easily altered simply by changing the size of the discharge openings 330. For example, it can be seen in FIG. 6 that at each of the discharge openings 330, metered fuel 92 flows outwardly through the opening around its periphery to form a circumferential array of the larger droplets $92_a$. The total combined flow area of the discharge openings 330 is larger than the opening in the fuel metering orifice 206 so that at each of the openings 330 the formed fuel droplets $92_a$ circumscribe a void area 340 in the center of the opening 330.

Figure 7:
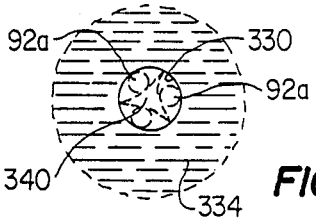
Figure 8:
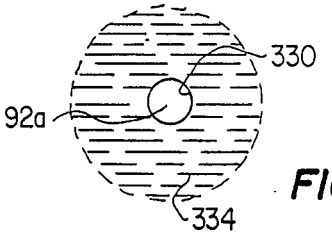

By decreasing the diameter of the discharge opening 330, as depicted in FIG. 7, the size of the fuel droplets $92_a$ is increased and the central void area 340 is decreased. By further decreasing the diameter of the discharge opening 330, a point is reached at which such opening is entirely filled with fuel so that a still larger, single fuel droplet $92_a$ is formed, and the central void area 340 is eliminated.

The nature of the larger droplet-small droplet flow rate ratio variation, together with the initial relationship between the two flow rates during the "startup" speed range of the engine, may also be selectively altered by changing the geometry of the spray ring 320. Specifically, by altering the weir depth "B", the merger point 338 of the droplet flow curves on the FIG. 5 graph may be selectively shifted to the left or right as desired. The depth "B" can be increased by increasing the axial length of the radially bent spray ring portion 324 and/or the bend angle "A". Similarly, the depth "B" may be decreased by axially shortening the bent spray ring portion 324 and/or decreasing the angle "A". Increasing the depth "B" will shift the merger point 338 to the right in FIG. 5, while decreasing the weir depth will shift the merger point to the left.

The larger droplet-to-small droplet flow rate ratio during the startup speed range of the engine may be easily altered simply by changing the size and/or spacing of the discharge openings 330. For example, if it is desired to increase the initial flow rate of the larger droplets $92_a$ relative to the small droplets $92_b$ during this low end speed range of the engine, the size of the openings 330 could be increased and/or the circumferential spacing between the openings decreased. To decrease such initial flow rate ratio, the size of the discharge openings 330 could be decreased and/or the circumferential spacing between such openings increased.

It can readily be seen from the foregoing that by making simple configurational adjustments to the spray ring 320, the droplet curves on the FIG. 5 graph can be custom shaped to suit the operating characteristics of the particular engine with which the carburetor 300 is operatively associated. By virtue of its formation and discharge of the differently sized fuel droplets $92_a$ and $92_b$, coupled with its ability to automatically vary the flow rate relationship between the differently sized droplets as a function of engine speed, the spray ring 320 advantageously provides the ability to significantly improve the combustion characteristics of the fuel-air mixture produced by the carburetor 300 in a manner which increases the power output of the engine, increases its fuel efficiency, and reduces its emission pollutant levels.

Figure 9:
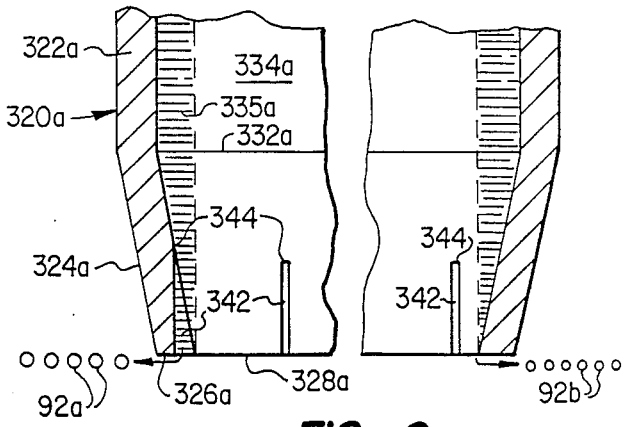
FIG. 9 is a fragmentary, diametrically foreshortened cross-sectional view through a representative alternate embodiment of the spray ring and schematically illustrates the centrifugal, simultaneous discharge therefrom of different sized fuel droplets.

The means associated with the spray ring 320 for producing the larger atomized fuel droplets $92_a$ may, if desired, be given configurations and locations different than those of the illustrated discharge openings 330. For example, an alternate embodiment $320_a$ is representatively illustrated in FIG. 9 and incorporates modified discharge means for forming the larger fuel droplets $92_a$. Portions of the spray ring $320_a$ similar to those in the spray ring 320 have been given identical reference numerals, but with the subscripts "A".

In the modified spray ring $320_a$, the annular array of mutually spaced discharge openings 330 is replaced with a circumferentially spaced series of axially extending grooves or slots 342 formed in the interior side surface of the lower spray ring portion $324_a$ and opening outwardly at their lower ends through the annular lower end surface $326_a$ and passing through circumferentially spaced segments of the spray edge $328_a$. Since the upper ends 344 of the slots 342 are positioned above the spray edge $328_a$, the slots perform the same general function as the discharge openings 330 in the spray ring 320 by defining fuel discharge passages which initially present a flow path of lesser resistance (compared to the flow path extending around and over the spray edge) for the metered fuel as the thickness of the fuel layer $335_a$ is building up to its maximum thickness. Accordingly, the metered fuel simultaneously passes over the spray edge $328_a$ to form the droplets $92_b$, and downwardly through the slots 342 to form at their lower ends the larger fuel droplets $92_a$.

Referring again to FIGS. 1 and 2, to further reduce the emission pollutant levels of the engine with which it is operatively associated, the improved rotor-type carburetor 300 is also provided with a unique fuel scavenging system 350 which functions to capture fuel discharged from the turbine rotor, during spindown periods thereof in the absence of air flow through the carburetor, which would otherwise be unnecessarily and undesirably delivered to the engine and at least temporarily increase its emission pollutants and decrease its fuel efficiency. Fuel captured by the scavenging system 350 is automatically returned to the fuel supply system 302 (FIG. 1) in a manner subsequently described.

The fuel scavenging system 350 includes an annular, rectangularly cross-sectioned groove 352 formed in the interior surface 82 of the carburetor body 18. The groove 352 coaxially and outwardly circumscribes the spray ring 320 and extends downwardly beyond its annular lower end surface 326. An axially stacked series of relatively thin washer elements 354 are captively retained within the groove 352 and define therebetween annular capillary passages 356. A small fuel return or transfer conduit 358 communicates at one end thereof with the interior of the groove 352, and is operatively connected at its other end to an angled inlet portion 360 (FIG. 1) of a venturi fitting 362 operatively interposed in the fuel recirculation line 310.

When air flow through the carburetor passage 80 is terminated, the larger and smaller atomized fuel droplets $92_a$ and $92_b$ radially discharged from the still-spinning spray ring 320 strike the radially inner surfaces of the stacked washers 354 and/or a portion of the interior carburetor body surface 82 above them. Fuel striking these surfaces is drawn by capillary action through the passages 356 between the stacked washers 354 and into the annular carburetor body groove 352. The fuel captured in this manner in the groove is drawn outwardly therefrom, via the fuel transfer conduit 358, by the venturi fitting 362 and flowed into the recirculating line 310 for return to the engine's fuel tank 308.

When air flow through the air flow passage 80 is reestablished, the engine-ingested air 90 entrains and axially sweeps away the fuel droplets being radially discharged from the spinning spray ring 320 to prevent the droplets from being captured by the scavenging system 350 and returned to the engine's fuel supply system 302 as previously described.

The foregoing detailed description is to be clearly understood as being given by way of illustration and example only, the spirit and scope of the present invention being limited solely by the appended claims.

What is claimed is:

1. A rotor-type carburetor for use with an initial combustion engine having a fuel supply system, said carburetor comprising:

a body having an air flow passage extending therethrough along an axis;

turbine rotor means carried by said body for rotation within said air flow passage about said axis in response to air flow through said air flow passage;

centrifugal pump means formed within said turbine rotor means and responsive to rotation thereof for receiving fuel from the fuel supply system and discharging the received fuel from said turbine rotor means for mixture with air traversing said air flow passage; and fuel scavenging means for capturing fuel discharged from said turbine rotor means during spin-down periods thereof to prevent the discharged fuel from being delivered to the engine, and for returning the captured fuel to the fuel delivery system, said fuel scavenging means including means for defining a series of capillary passages positioned, to receive the discharged fuel, and means for transferring the discharged fuel received by said capillary passages to the fuel supply system.

2. The rotor-type carburetor of claim 1 wherein:

said means for defining a series of capillary passages include a depression formed in the interior surface of said body, and a plurality of capillary members received in said depression and collectively defining said series of capillary passages, and said means for transferring the discharged fuel include conduit means extending between said depression and the fuel supply system.

3. The rotor-type carburetor of claim 2, wherein:

said centrifugal pump means include a spray ring carried by said turbine rotor means, said depression is an annular groove formed in the interior surface of said body, said groove coaxially and outwardly circumscribing said spray ring, and said capillary members comprise an axially stacked series of flat annular washer elements.

4. The rotor-type carburetor of claim 3 wherein:

the fuel supply system includes a fuel tank, a fuel pump and a fuel recirculation line interconnected between said fuel tank and the output of said fuel pump, and said means for transferring the discharged fuel comprise a venturi fitting operatively interposed in said fuel recirculation line and having an inlet portion, and a transfer conduit communicating said inlet portion with the interior of said annular groove to thereby draw captured fuel therefrom into said fuel recirculation line.

5. A rotor-type carburetor for use with an internal combustion engine, comprising:

a body having an air flow passage extending therethrough along an axis;

turbine rotor means carried by said body for rotation within said air flow passage about said axis in response to air flow through said air flow passage;

passageway means, formed in said turbine rotor means, for centrifugally flowing a metered quantity of fuel from a source thereof through said turbine rotor means in response to rotation thereof; and discharge means for receiving the metered fuel from said turbine rotor means, during rotation thereof, and discharging it in the form of first and second series of differently sized, atomized fuel droplets for mixture with air traversing said air flow passage, the fuel droplets in said first series thereof having a predetermined size relationship with the droplets in said second series thereof, said discharge means including a spray ring carried by said turbine rotor means and having first means associated therewith for forming said first series of fuel droplets, and second means associated therewith for forming said second series of fuel droplets.

6. The rotor-type carburetor of claim 5 wherein:

said spray ring has a radially inwardly bent axial end portion, said first means include a mutually spaced series of fuel discharge passages each extending from an interior surface of said spray ring to an exterior surface thereof, and said second means include an annular spray edge formed around the outer end of said axial end portion of said spray ring.

7. The rotor-type carburetor of claim 6 wherein:

said fuel droplets in said first series thereof are larger than said fuel droplets in said second series thereof.

8. The rotor-type carburetor of claim 6 wherein:

said mutually spaced series of fuel discharge passages comprise a mutually spaced annular series of generally axially extending slots formed in the interior surface of said spray ring and opening outwardly through said outer end of said axial end portion of said spray ring.

9. The rotor-type carburetor of claim 6 wherein:

said axial end portion of said spray ring is radially inwardly bent at an angle of from about 10° to about 20°.

10. The rotor-type carburetor of claim 9 wherein:

said axial end portion of said spray ring is radially inwardly bent at an angle of approximately 14°.

11. The rotor-type carburetor of claim 6 wherein:

said mutually spaced series of fuel discharge passages comprise a mutually spaced annular series of laterally extending fuel discharge openings formed through said spray ring and circumscribing its axis.

12. The rotor-type carburetor of claim 11 wherein:

said fuel discharge openings have generally circular cross-sections.

13. The rotor-type carburetor of claim 12 wherein:

said annular series of fuel discharge openings are positioned adjacent the juncture between said axial end portion of said spray ring and the balance of said spray ring.

14. A rotor-type carburetor for use with an interior combustion engine having a fuel supply system adapted to supply fuel to said rotor-type carburetor, comprising:

a body having an air flow passage extending therethrough along an axis;

turbine rotor means carried by said body for rotation within said air flow passage about said axis in response to air flow through said air flow passage;

passageway means, formed in said turbine rotor means, for centrifugally flowing a metered quantity of fuel from a source thereof through said turbine rotor means in response to rotation thereof, discharge means for receiving the metered fuel from said turbine rotor means, during rotation thereof, and discharging it in the form of first and second series of different sized, atomized fuel droplets for mixture with air traversing said air flow passage, the fuel droplets in said first series thereof having a predetermined size relationship with the droplets in said second series thereof; and fuel scavenging means for capturing fuel discharged from said discharge means during spin-down periods of said turbine rotor means to prevent the discharge fuel from being delivered to the engine, and for returning the captured fuel to the fuel delivery system, said fuel scavenging means including:

capillary passage means, formed in the interior of said body, for receiving fuel discharged from said discharge means, and transfer means for transferring fuel received by said capillary passage means to the fuel supply system of the engine.

15. The rotor-type carburetor of claim 14 wherein:

the fuel supply system has a fuel pump with a fuel recirculation line operatively connected thereto, said capillary passage means include an annular groove formed in the interior surface of said body and circumscribing said axis, and an axially stacked series of annular washer elements carried in said groove, and said transfer means include a venturi fitting installed in said fuel recirculation line and having an inlet adapted to draw fuel from a source thereof into said fuel recirculation line in response to fuel flow therethrough, and a fuel transfer conduit interconnected between said groove an said inlet.

16. A rotor-type carburetor for use with an internal combustion engine, comprising:

a body having an air flow passage extending therethrough along an axis;

turbine rotor means carried by said body for rotation within said air flow passage in response to air flow therethrough;

passageway means, formed in said turbine rotor means, for centrifugally flowing a metered quantity of fuel from a source thereof through said turbine rotor means in response to rotation thereof; and discharge means for discharging the metered fuel in the form of first and second series of differently sized, atomized fuel droplets for mixture with air traversing said air flow passage, the fuel droplets in said first series thereof having a predetermined size relationship with the fuel droplets in said second series thereof, and for automatically varying, in a predetermined manner, the ratio of the flow rate of the fuel droplets in said first series thereof to the flow rate of the fuel droplets in said second series thereof, said discharge means including a spray ring having a radially inner side surface, a radially inwardly bent axial end portion having a spray edge formed thereon, and at least one fuel discharge passage formed in said inner side surface and opening outwardly through an exterior surface of said spray ring, said spray ring being adapted to receive a flow of metered fuel along said inner side surface and simultaneously discharge the received fuel outwardly through said at least one fuel discharge passage and across said spray edge to respectively form said first and second series of fuel droplets.

17. The rotor-type carburetor of claim 16 wherein:

said spray edge is annularly configured and is positioned at the outer end of said radially inwardly bent axial end portion of said spray ring, and said spray ring has a mutually spaced annular series of generally axially extending fuel discharge passages formed in said inner side surface of said spray ring and opening outwardly through said outer end of said radially inwardly bent axial end portion of said spray ring.

18. The rotor-type carburetor of claim 16 wherein:

said axial end portion of said spray ring is radially inwardly bent at an angle of from about 10° to about 20°.

19. The rotor-type carburetor of claim 18 wherein:

said axial end portion of said spray ring is radially inwardly bent at an angle of approximately 14°.

20. The rotor-type carburetor of claim 16 wherein:

said spray edge is annularly configured and is positioned at the outer end of said radially inwardly bent axial end portion of said spray ring, and said spray ring has a mutually spaced annular series of generally laterally extending fuel discharge passages formed therethrough and circumscribing said axis.

21. The rotor-type carburetor of claim 20 wherein:

said annular series of fuel discharge passages are axially adjacent the juncture between said axial end portion of said spray ring and the balance of said spray ring.

22. The rotor-type carburetor of claim 21 wherein:

said fuel discharge passages have circular cross-sections.

23. A rotor-type carburetor for use with an internal combustion engine, comprising:

a body having an air flow passage extending therethrough along an axis;

turbine rotor means carried by said body for rotation within said air flow passage in response to air flow therethrough;

passageway means, formed in said turbine rotor means, for centrifugally flowing a metered quantity of fuel from a source thereof through said turbine rotor means in response to rotation thereof; and discharge means for discharging the metered fuel in the form of first and second series of differently sized, atomized fuel droplets for mixture with air traversing said air flow passage, the fuel droplets in said first series thereof having a predetermined size relationship with the fuel droplets in said second series thereof, and for automatically varying, in a predetermined manner, the ratio of the flow rate of the fuel droplets in said first series thereof to the flow rate of the fuel droplets in said second series thereof, said fuel droplets in said first series thereof being larger than said fuel droplets in said second series thereof, and said flow rate ratio being varied by said discharge means in a manner such that during a first, relatively low speed range of the engine the magnitude of said ratio is greater than its magnitude during a second, relatively higher speed range of the engine.

24. The rotor-type carburetor of claim 23 wherein:

during said first, relatively low engine speed range the flow rate of fuel droplets in said first series thereof is greater than the flow rate of fuel droplets in said second series thereof.

25. The rotor-type carburetor of claim 24 wherein:

said first, relatively low speed range of the engine is a low end portion of its overall speed range.

26. The rotor-type carburetor of claim 25 wherein:

during said second, relatively higher speed range of the engine the flow rate of fuel droplets in said first series thereof at least closely approximates the flow rate of fuel droplets in said second series thereof.

27. The rotor-type carburetor of claim 26 wherein:

during said second, relatively higher speed range of the engine the flow rate of fuel droplets in said first series thereof is generally equal to the flow rate of fuel droplets in said second series thereof.

28. The rotor-type carburetor of claim 27 wherein:

said second, relatively higher speed range of the engine is the balance of its overall speed range beyond said low end portion thereof.

29. A method of atomizing fuel exiting the turbine rotor section of a rotor-type carburetor, said method comprising the steps of:

providing atomizing means for receiving a flow of fuel and discharging the received fuel in the form of a first series of relatively large fuel droplets and a second series of relatively small fuel droplets; and positioning said atomizing means to operatively receive and discharge fuel exiting the turbine rotor section.

30. The method of claim 29 wherein:

said providing step is performed by providing a spray ring having a radially inwardly bent axial end portion with a spray edge formed around its outer end, and a mutually spaced series of fuel discharge passages each extending from an interior surface of said spray ring to an exterior surface thereof, and said positioning step is performed by coaxially securing said spray ring to said turbine rotor section in a manner such that during rotation thereof fuel exiting said turbine rotor section is flowed along an interior surface portion of said spray ring, outwardly through said fuel discharge passages to form said first series of fuel droplets, and across said spray edge to form said second series of fuel droplets.

31. The method of claim 29 further comprising the step of:

utilizing said atomizing means to automatically vary, in a predetermined manner, the larger droplet-to-smaller droplet flow rate ratio as a function of engine speed.

32. A method of preventing fuel delivery to an engine from a roto-type carburetor during rotor spin-down periods thereof, the engine having a fuel delivery system adapted to deliver fuel to the carburetor, said method comprising the steps of:

capturing fuel discharged from the carburetor during rotor spin-down periods thereof prior to the entry of the discharged fuel into the engine; and returning the captured fuel to the fuel delivery system, said capturing step being performed by forming capillary openings in the interior surface of the carburetor and receiving the discharged fuel in said capillary openings, and said returning step being performed by drawing the received fuel into the fuel supply system.

33. Apparatus for atomizing fuel exiting the turbine rotor section of a rotor-type carburetor, said apparatus comprising:

atomizing means for receiving a flow of fuel and discharging the received fuel in the form of a first series of relatively large fuel droplets and a second series of relatively small fuel droplets, said atomizing means being positioned to operatively receive and discharge fuel exiting the turbine rotor section.

34. The apparatus of 33 wherein said atomizing means include:

a spray ring having a radially inwardly bent axial end portion with a spray edge formed around its outer end, and a mutually spaced series of fuel discharge passages each extending from an interior surface of said spray ring to an exterior surface thereof, said spray ring being coaxially secured to said turbine rotor section in a manner such that during rotation thereof fuel exiting said turbine rotor section is flowed along an interior surface portion of said spray ring, outwardly through said fuel discharge passages to form said first series of fuel droplets, and across said spray edge to form said second series of fuel droplets.

35. The apparatus of claim 33 wherein:

said atomizing means are further operative to automatically vary, in a predetermined manner, the larger droplet-to-smaller droplet flow rate as a function of engine speed.

* * * * *